United States Patent [19]

Phillips

[11] Patent Number: 4,517,691

[45] Date of Patent: May 21, 1985

[54] MOTION DAMPING SYSTEM FOR WATER BED MATTRESSES

[76] Inventor: Raymond M. Phillips, 2566 Tuna Canyon Rd., Malibu, Calif. 90290

[21] Appl. No.: 259,461

[22] Filed: May 1, 1981

[51] Int. Cl.[3] ..... A47C 27/08

[52] U.S. Cl. ..... 5/450; 5/451

[58] Field of Search ..... 5/451, 452, 455, 449, 5/422, 450, 457

[56] References Cited

U.S. PATENT DOCUMENTS

| | | | |
|---|---|---|---|
| 4,296,510 | 10/1981 | Phillips | 5/451 |
| 4,301,560 | 11/1981 | Fraige | 5/451 |
| 4,325,152 | 4/1982 | Carpenter | 5/451 |
| 4,332,043 | 6/1982 | Larson | 5/451 |
| 4,345,348 | 8/1982 | Hall | 5/451 |
| 4,399,575 | 8/1983 | Hall | 5/451 |
| 4,462,128 | 7/1984 | La Bianco | 5/450 |
| 4,467,485 | 8/1984 | Hall | 5/451 |

FOREIGN PATENT DOCUMENTS

| | | | |
|---|---|---|---|
| 59123 | 9/1982 | European Pat. Off. | 5/451 |

*Primary Examiner*—Alexander Grosz

*Attorney, Agent, or Firm*—William H. Maxwell

[57] ABSTRACT

A free floating wave control unit in combination with a water bed mattress and detachably disposed interiorly therein and coextensive of the top panel of the mattress and comprised of a floatable frame carrying thick fiber batting underlying the top panel and free hanging curtains to intercept and damp out wave motion, and there being marginal walls of thick fiber batting adjacent to the side and end panels of the mattress to damp reflective wave motion.

20 Claims, 7 Drawing Figures

MOTION DAMPING SYSTEM FOR WATER BED MATTRESSES

BACKGROUND

Water beds are comprised of a frame that carries a liquid filled envelope upon which persons recline. The frame includes a platform having the plan configuration desired, and upstanding side and end walls that confine the overlying mattress to said plan configuration. Flat plastic sheet is employed in the mattress construction, folded and/or seam welded together in a rectangular envelope formation with a fill opening adapted to be closed. The envelope is filled with a heavy liquid such as water, whereby a person reclining is supported by means of flotation as a result of displacement. In a basic water bed mattress as thus far described there is an absence of means to prevent wave motion, and as a result continued sloshing is a characteristic disadvantage which adversely affects a number of persons who cannot tolerate it. Heretofore, various arrangements of surge controlling baffles have been proposed, but with complexity and at considerable expense. Therefore, it is a general object of this invention to damp out wave motion in liquid filled mattresses, without resort to the complexities of the prior art baffles attached to the mattress envelope.

Flotation mattresses of the type here under consideration have been made with various forms and types of baffles, incorporated therein and attached to the outside envelope, all of plastic materials, and designed to reduce wave motion by means of compartmenting and flow restriction therethrough. The multiplicity of compartments and their attachment to the outside envelope becomes complicated and costly, it being an object of this invention to provide a detached means which damps wave motion, all without fastening to the plastic walls of the mattress which heretofore was thought to be necessary. With the present invention, a detached motion damping means is positioned by flotation within the outside envelope, to carry depending curtains that impede wave motion.

It is the phenomenon of wave motion in heavy liquid such as water with which the present invention is primarily concerned. In practice, when a person applies his or her weight onto the top surface of a water bed mattress, sudden displacement as is required by flotation of that person causes liquid motion with inertia from the position of that person, in the form of moving waves. These waves move horizontally and reflect from the side and end walls of the mattress which are backed by the hard structural retaining walls of the frame, and it is these waves which this invention hastens to dissipate and/or absorb. Accordingly, it is an object of this invention to reduce and to substantially eliminate the direct as well as reflective wave motion in liquid filled mattresses. To these ends, curtains depend from flotation members and within and between which bodies of liquid are entrapped and movement thereof restricted. Also, a thick fiber batting is carried by the flotation members and against which reflective wave motion is reduced.

The depth of water bed mattresses is predicated upon maximum anticipated weight of the persons to be supported thereby, and eight and one half ($8\frac{1}{2}$) inches is the norm or depth of such a mattress. However, there are occasions when the top panel of the mattress will bottom out upon the bottom panel, and to this end it is an object of this invention to provide the aforesaid thick fiber batting that presents a coextensive pad that prevents and/or cushions bottoming.

The features hereinabove referred to are incorporated in a flotation unit comprised of shaping bars made of floatable material and to which the wave controlling curtains and fiber batting are attached. The unit is free floating, constructed of polyvinylchloride, polyethylene and polyester plastic materials, and the like. It is an object to employ such materials that are durable, non degradable and resistant to age, and therefore reliable.

SUMMARY OF THE INVENTION

This invention relates to water bed mattresses wherein means is provided to rapidly damp out and eliminate wave motion as caused by the sudden application of persons weight thereto, or the like. Prior art baffles and attached panel walls are replaced herein by a free floating unit that remains detached and adapted to inherently seek a proper operating position interiorly of the mattress envelope. Wave motion damping means is embodied in the free floating unit and in the form of a bouyant frame with depending curtains and thick fiber batting arranged and disposed as hereinafter described to lessen wave motion. The thick fiber batting is coextensive of the frame so as to underlie the top panel of the mattress envelope and thereby provide extra underlying support and surface flatness. As will be described, the curtain and batting are arranged to intercept and control wave motion.

The foregoing and other various objects and features of this invention will be apparent and fully understood from the following detailed description of the typical preferred forms and applications thereof, throughout which description reference is made to the accompanying drawings.

Figure 1:
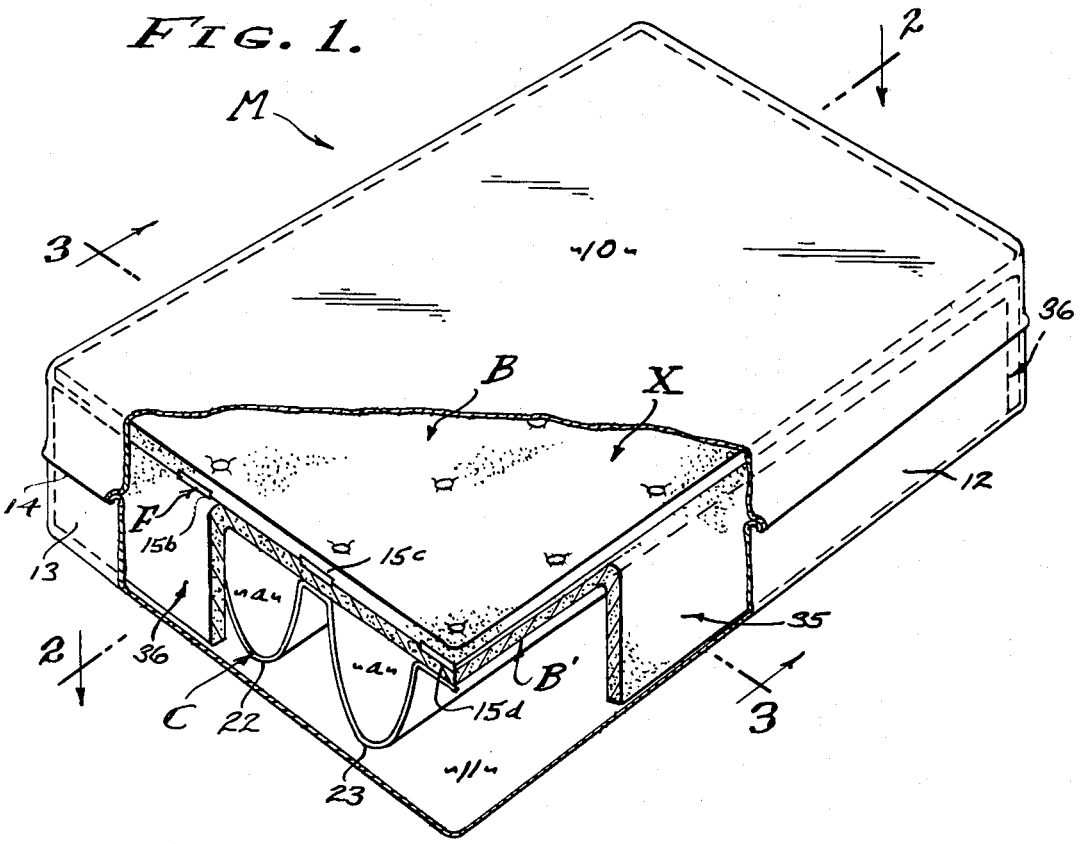
FIG. 1 is a perspective view of a water bed mattress with portions broken away to reveal the free floating wave control unit of the present invention.
Figure 2:
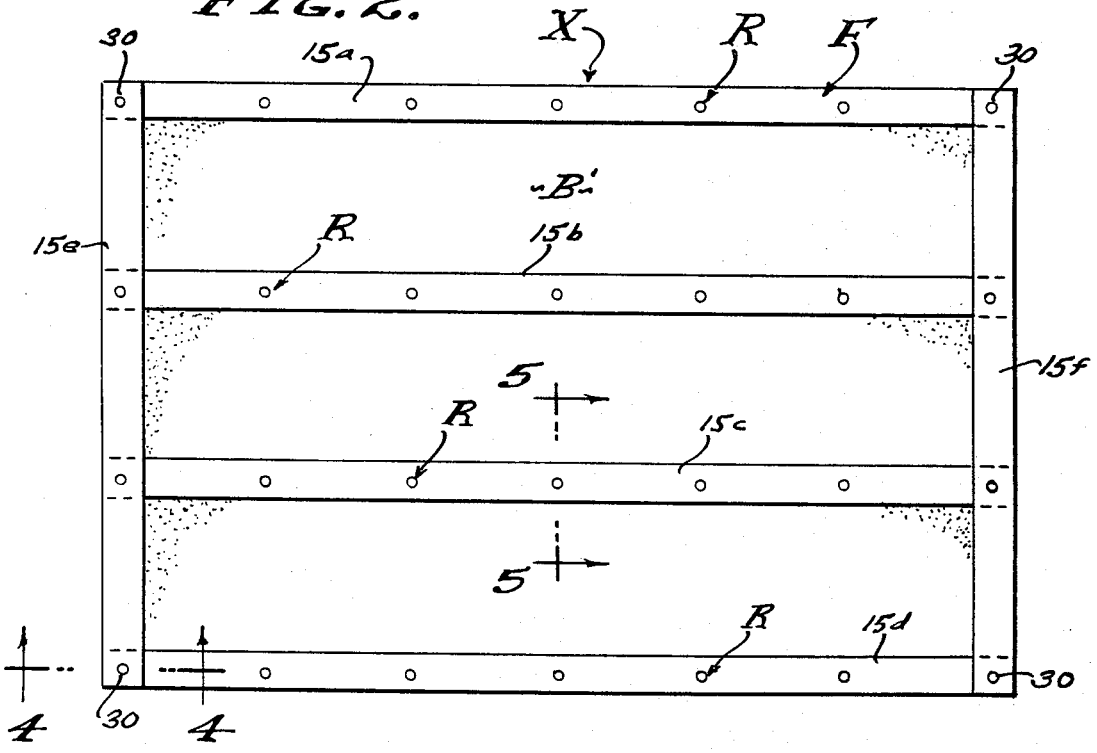
FIG. 2 is a plan view of the floating wave control unit with the top layer of batting removed and apart from the mattress envelope, taken as indicated by line 2—2 on FIG. 1.
Figure 4:
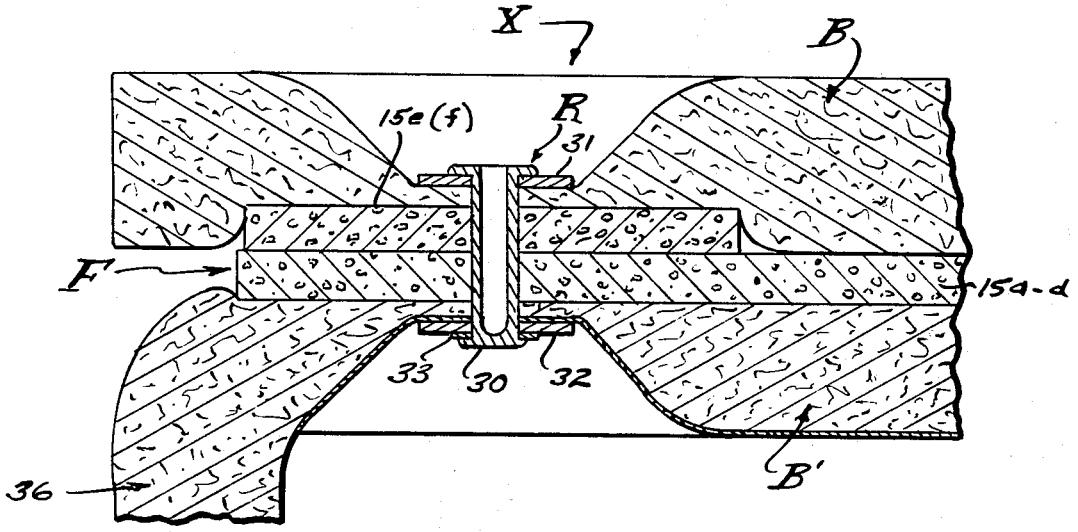
Figure 5:
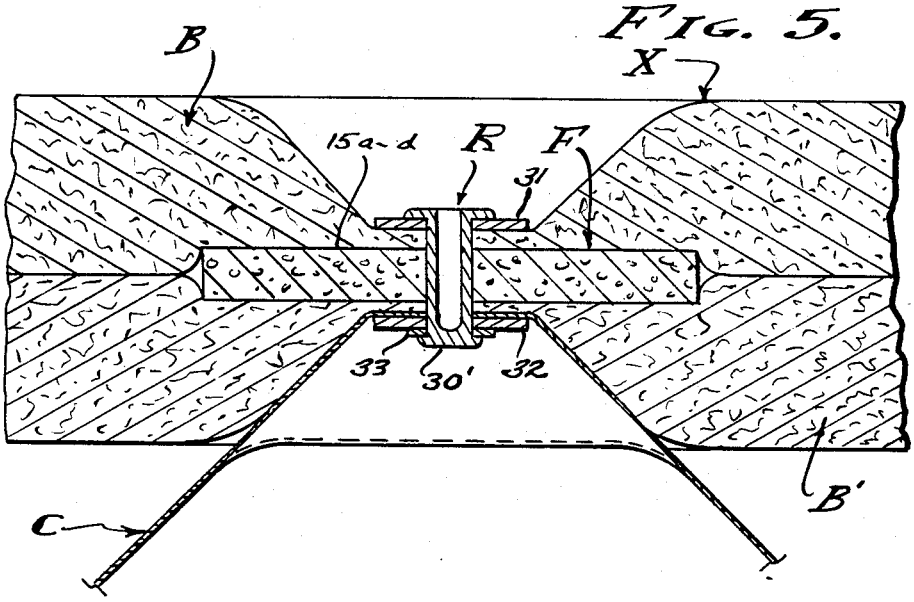

FIGS. 4 and 5 are enlarged detailed fragmentary views taken as indicated by lines 4—4 and 5—5 on FIG. 2.

Figure 3:
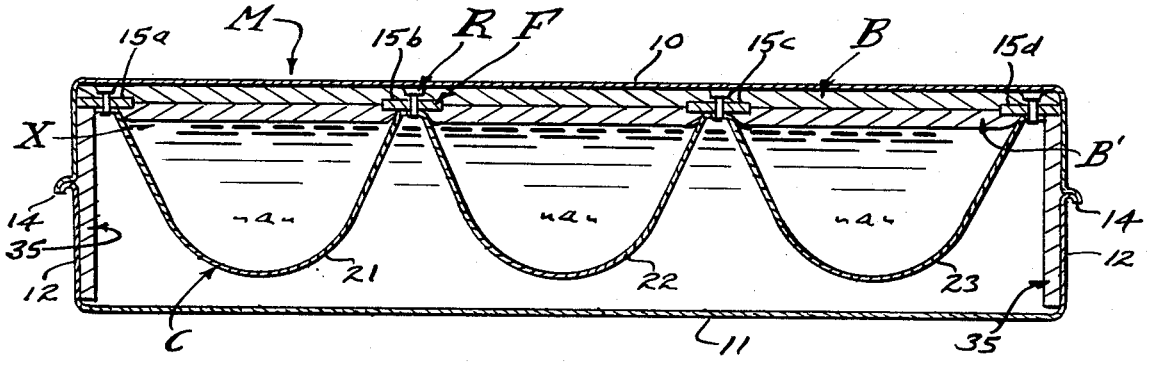
FIG. 3 is an enlarged transverse sectional view taken as indicated by line 3—3 on FIG. 1.
Figure 6:
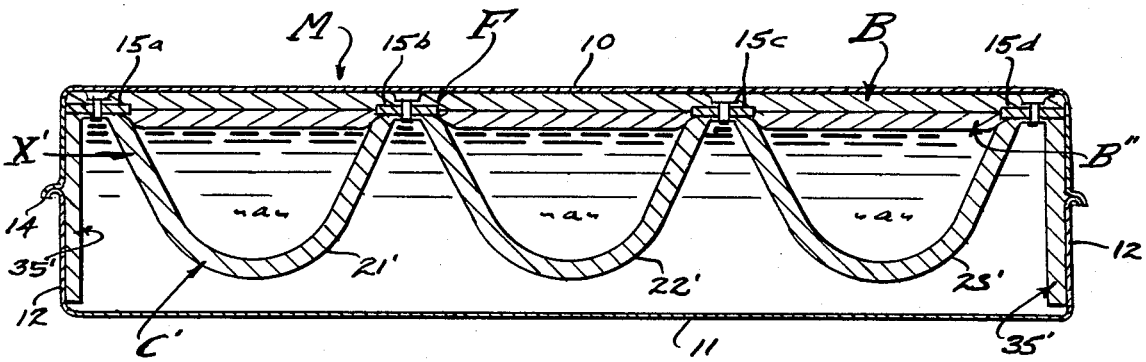
Figure 7:
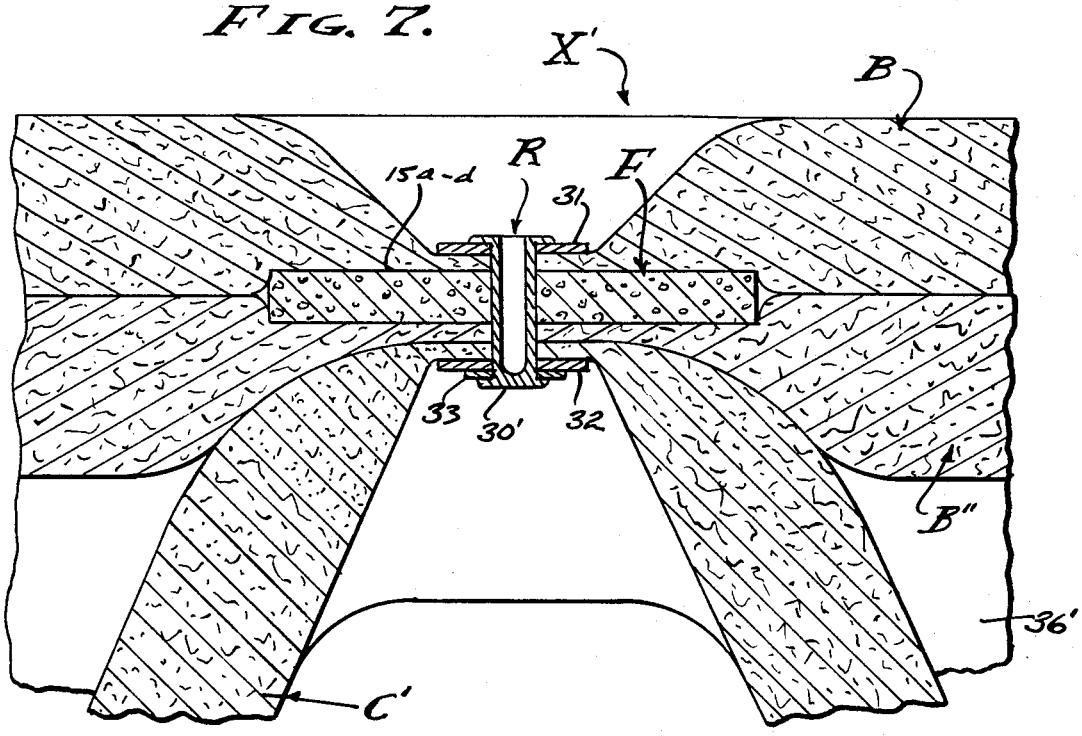

And, FIGS. 6 and 7 are enlarged detailed fragmentary views similar to FIGS. 3 and 5, showing a second modified form of the invention.

PREFERRED EMBODIMENT

Referring now to the drawings, this invention involves a basic flotation mattress structure M comprised of an envelope of thin, flexible and supple plastic sheet material such as polyvinylchloride. The mattress M is rectangular in plan configuration and is characterized by flat, horizontal and vertically spaced top and bottom panels 10 and 11, and flat vertical side and end panels 12 and 13 formed as continuations of and extending between the perimeters of said top and bottom panels. The several walls or panels 10–13 are welded or otherwise joined together, as shown, to establish a sealed and water-tight bladder or envelope.

The basic mattress structure M described briefly above can, for example, be made or established in accordance with the teaching of U.S. Pat. No. 4,125,975 for Water Bed Mattress issued May 31, 1977 to Raymond M. Phillips and William J. Pease. The details of construction and the manufacturing techniques employed in making the above described mattress can be varied widely, since the floating control unit X of the present invention is in practice detached and simply accommodated therein. Accordingly, this disclosure need not and does not burden the reader with any further illustration and description other than that described above concerning the mattress structure M.

The wave motion control unit X is a free-floating motion-reducing pad and curtain device held to the plan configuration of the flotation mattress M by means of a floating frame F carrying thick fiber batting B and from which curtain means C depend. Non-degradable plastic materials are used in the unit construction, all of low density and in combination to displace the liquid medium, water, and so as to float to the surface thereof within the confines of the mattress envelope above described. The wave control unit X is planar and floats to the underside surface of the top panel 10 to be in coextensive supporting contact therewith, while the curtains C depend to the bottom panel 11. The wave control unit X is fabricated as will be described, and the panels 10–13 of the mattress M are assembled over the wave control unit X and seam welded together as shown at 14 to envelope the said unit. Both the wave control unit X and mattress M are of conventional rectangular plan configuration, one conforming to and compatable with the other, so that the wave control unit X remains properly oriented within the confines of the mattress M. The plastic materials of the construction remain flexible, including the frame F, so that the completed mattress M and wave control unit X can be folded for storage and transport when empty of liquid, and all without damage thereto.

The frame F is fabricated of floating bar-like members 15*a*–15*f* made of closed cell Polyethylene foamed plastic of ¼"×3" cross section having low density for substantial bouyancy and of considerable structural integrity and/or rigidity, yet pliable and adapted to be warped and bent out of their normal planar condition. Warping and bending of the shaping bar members is witout destruction thereto and conducive to the conformation of the frame F to the contours imposed by a person reclining upon the mattress M. In accordance with this invention there is a multiplicity of floating members and preferably four such members 15*a*, 15*b*, 15*c*, and 15*d* extending longitudinally of the mattress M, spaced and parallel one with the other and joined into a rectangular configuration by cross members 15*e* and 15*f*. The cross members 15*e* and 15*f* are disposed transversely at the head and foot of the mattress M. The cross members 15*e* and 15*f* are joined with the members 15*a*–15*d* as shown in FIG. 3 and as detailed in FIG. 4. A feature is the soft non-injurious nature of the members 15*a*–15*f*, so that the edges and corners thereof are depressible and unnoticable, and also non-damaging to the sheet panels 10–13 of the mattress M.

A coextensive layer of thick fiber batting B overlies at least the upper side of the floating frame F, and preferably thick fiber batting B and B′ overlie and underlie the floating frame F. The thick fiber batting B and B′ is made of Polyester plastic fibers 1" in thickness and having a weight per volume only slightly greater than that of water, so as to be substantially light weight when immersed therein. As shown, the fibers of the batting are interengaged in a soft depressible mat. A feature of said thick fiber batting B and B′ is its resilience and compressibility at the fasteners later described, which are received therein so as to be unnoticable. The thick fiber battings B and B′ have the same plan configuration as the floating frame F, and also of the interior of the matters M envelope.

The wave control curtain means C is fabricated of imperforate sheet material made of 24 gauge Polyvinylchloride plastic, of 0.024 inch thickness, and which is a strong and pliable material adapted to be firmly secured to the floating frame F. Said curtain material has a weight per volume greater than that of water, so as to sink therein and thereby to depend from the floating frame F. There is a plurality of wave control curtains C arranged in swag formation and hanging down in the middle between the above described floating frame members 15*a*–15*d*, as best shown in FIG. 3. That is, the swag-shaped curtains C hang loosely and heavily sink down as shown. There are four longitudinally disposed frame members 15*a*, 15*b*, 15*c*, and 15*d*, in which case there are three looped swag sections 21, 22 and 23 suspended by and depending from the said frame members. In practice, the swag sections are integrally formed of a single sheet of the aforesaid material, each section 21, 22 and 23 hanging in a curve between a pair of said floating frame members. The looped swag sections are alike or identical, as they are secured to the equally spaced frame members 15*a*, 15*b*, 15*c* and 15*d*. Accordingly, members 15*a* and 15*b* carry the suspended swag curtain section 21 supported from its opposite parallel margins, members 15*b* and 15*c* carry the suspended swag curtain section 22 supported from its opposite parallel margins, and members 15*c* and 15*d* carry the suspended swag curtain section 23 supported from its opposite parallel margins. In accordance with this invention, the swag sections 21, 22 and 23 depend to the bottom panel 11 of the mattress M envelope, and they each form a chamber a, as shown, having open ends juxtaposed to the end panels 12 and 13 of the mattress M envelope. The curtain sections 21, 22 and 23 are collapsible within the confines of the mattress M envelope, and they are free to hang therein from the floating frame F.

The aforesaid floating frame F, battings B and B′ and the wave control curtain means C are arranged as hereinabove described, and as shown they are cooperatively secured together in an assembly to occupy the interior of the envelope unit. That is, these designated elements of the combination are assembled and fastened together as an operable unit that floats within the mattress M envelope. In accordance with this invention, the elements F, B and C are fastened together as by means of rivets which extend therethrough at close intervals as required to ensure integrity of the unit, substantially as shown in the drawings. At each corner of the unit and at each frame member connection there is a fastening means R in the form of a rivet 30, and intermediate rivets 30′ are secured through the frame members at suitable intervals along the frame members 15*a*–15*d* as they extend between the transverse frame members 15*e* and 15*f*. In practice, the rivets 30 and 30′ are alike and of a length to accommodate the thickness of material to be fastened as shown in FIGS. 4 and 5. It is preferred that a plastic tubular rivet be employed to draw a pair of large diameter washers 31 and 32 into opposed relation, also of plastic such as Nylon of Teflon as manufactured by DuPont. And said rivets 30 and 30′ are headed as by applying heat and pressure axially thereto and against a small diameter hard washer 33 of metal such as aluminum or the like. It will be seen that the rivets 30 and 30' are headed against the washers 31 and 32 with the unit elements clamped therebetween. The batting is greatly compressed against the frame members that are slightly depressed, and the curtain material hangs free in looped formation as shown to swing free in swag formation from the frame members 15*a*–15*d*.

A feature of this invention is the retardation of reflective wave motion, and accordingly there are damping walls 35 and 36 juxtaposed to the panels 12 and 13 of the mattress M. The damping walls 35 are coextensive each with the panels 12, while the damping walls 36 are coextensive each with the panels 13. In practice, these walls are continuations of either the top pad or bottom pad of fiber batting, and preferably the latter batting B. Said walls are of the thick fiber batting having a weight per volume greater than that of water, so as to sink therein and thereby depend from the floating frame F. Accordingly, the thick fiber batting B is shown as depending from the edges of the floating frame F as defined by the side and end members thereof, to hang freely to the bottom panel 11, at all four edges thereof.

Referring now to FIGS. 6 and 7 and to the second modified form of this invention, the wave control curtain means C' is fabricated of thick fiber batting of Polyester plastic fiber 1" in thickness, the same as the batting B and B' above described. As shown, the reflection damping walls 35' and 35' depend from the curtain C', in which case the lowermost batting B" is devoid of walls 35' at the sides of the mattress envelope. However, it is preferably the batting B" that carries the end walls 36' (see FIG. 7). Said curtain material has a weight per volume greater than that of water, so as to sink therein and thereby depend from the floating frame F. The looped swag sections 21', 22' and 23' of control curtain means C' are integral and are suspended as hereinabove described with respect to the means C.

From the foregoing, it will be seen that the elements of this motion damping water bed mattress system are easily manufactured and readily assembled into a securely fastened combination adapted to storage and transport when deflated, and adapted to attain and maintain a proper working position when the liquid filled mattress M is disposed in the usual bed frame (not shown). When displacement of liquid is experienced by sudden depression of a body weight into the top panel 10 of the mattress M, there is a commensurate propagation of wave motion emanating laterally from the place of depression. This wave motion moves the liquid trapped within the confines of the wave control curtains C (C'), the volume of which resists change by virtue of its entrapment within chambers a. And, only longitudinal displacement from the open ends of the chamber a permits a change in said volume. Consequently, the wave control curtains C (C') draw tight between the rising side of the wave and the falling side of the wave. Thus, the looped curtains apply reciprocal tension forces that immediately retard motion by restraining the rising movements. The softness of the depending walls 35 and 36 (35' and 36') of thick fiber batting intercepts any wave movement and presents a poor surface for reflection; a surface replete with underlying interstices between the many fibers of substantial depth. As a consequence, liquid movements are impaired and are quickly dissipated, and all to the end that the mattress M is immediately quieted without contined undulating motions which characterize other such mattresses.

Having described only the typical preferred forms and applications of my invention, I do not wish to be limited or restricted to the specific details herein set forth, but wish to reserve to myself any modifications or variations that may appear to those skilled in the art as set forth in the limits of the following claims.

I claim:

1. In combination, a flotation mattress comprised of an envelope of supple sheet material with a top body supporting panel and a bottom panel joined thereto by vertical side walls when filled with liquid, and a free floating wave motion damping unit detached from and adapted to seek a proper operating position interiorly of the mattress envelope; said floating wave motion damping unit including, a flexible frame of low density material for substantial bouyancy and having side members closely conforming to a plan configuration defined by the side walls of the mattress envelope, a pad of flexible batting carried by the frame and engageable with the top body supporting panel at the interior of said envelope, flexible batting hanging freely from the side members of said flexible frame and juxstaposed to the side walls of the mattress envelope to reduce reflected wave motion, and curtain means of supple sheet material having a weight per volume greater than water and hanging freely from the frame in tube form with opposite ends opening closely to the side walls of the mattress for flow restriction and the entrapment of liquid therein so as to retard wave motion over the bottom of the mattress when depressed by downward displacement of the supporting panel to engage the bottom of the mattress.

2. The combination of a mattress and wave motion damping unit as set forth in claim 1, wherein said damping unit frame is comprised of interconnected shaping members to which the pad of flexible batting and the hanging curtain means are attached.

3. The combination of a mattress and wave motion damping unit as set forth in claim 1, wherein said damping unit frame is comprised of at least one buoyant foamed plastic closed cell member to which the pad of flexible batting and the hanging curtain means are attached.

4. The combination of a mattress and wave motion damping unit as set forth in claim 1, wherein said damping unit frame is comprised of interconnected shaping bar-like members to which the pad of flexible batting and the hanging curtain means are attached.

5. The combination of a mattress and wave motion damping unit as set forth in claim 1, wherein said damping unit frame is comprised of interconnected shaping bar-like members of buoyant foamed plastic closed cell material to which the pad of flexible batting and the hanging curtain means are attached.

6. The combination of a mattress and wave motion damping unit as set forth in claim 1, wherein said damping unit frame is comprised of a plurality of parallel bar-like members and spaced transverse interconnecting members of shaping foamed plastic closed cell material to which the pad of flexible batting and the hanging curtain means are attached.

7. The combination of a mattress and wave motion damping unit as set forth in any one of claims 2 through 6, and wherein said pad of flexible batting is coextensive with the top body supporting panel and of soft plastic substantially light weight fibers immersed in the liquid.

8. The combination of a mattress and wave motion damping unit as set forth in any one of claims 1 through 6, wherein the frame is planar and wherein a complementary pad of flexible batting underlies the frame and comprised of soft plastic substantially light weight fibers immersed in the liquid.

9. The combination of a mattress and wave motion damping unit as set forth in any one of claims 1 through 6, and wherein two complementary pads of flexible batting coextensively overlie and underlie and embrace the frame and are comprised of plastic substantially light weight fibers immersed in the liquid.

10. The combination of a mattress and wave motion damping unit as set forth in claim 1, wherein said pad of flexible batting is soft and of plastic substantially light weight fibers immersed in the liquid.

11. The combination of a mattress and wave motion damping unit as set forth in claim 1, wherein said pad of flexible batting is coextensive with the top body supporting panel and of soft plastic substantially light weight fibers immersed in the liquid.

12. The combination of a mattress and wave motion damping unit as set forth in claim 1, wherein the said curtain means of tube form is comprised of at least one loosely hanging swag of supple sheet material hanging freely from the frame of the floating wave motion damping unit.

13. The combination of a mattress and wave motion damping unit as set forth in claim 1, wherein said damping unit frame extends between ends of the mattress envelope, and wherein the said curtain means of tube form is comprised of at least one loosely hanging swag of supple material extending between said ends and hanging freely to a substantial depth of the mattress envelope.

14. The combination of a mattress and wave motion damping unit as set forth in claim 1, wherein said damping unit frame is comprised of spaced shaping members to which the pad of flexible batting is attached and from which the curtain means of tube form is suspended freely between said members in the form of at least one loosely hanging swag.

15. The combination of a mattress and wave motion damping unit as set forth in claim 1, wherein said damping unit frame is comprised of spaced shaping members extending between ends of the mattress envelope and to which the pad of flexible batting is attached and from which the curtain means of tube form is suspended freely between said members in the form of at least one loosely hanging swag.

16. The combination of a mattress and wave motion damping unit as set forth in claim 1, wherein said dapming unit frame is comprised of spaced shaping members extending between ends of the mattress envelope and to which the pad of flexible batting is attached and from which the curtain means of tube form is suspended freely between said members in the form of at least one open ended loosely hanging swag.

17. The combination of a mattress and wave motion damping unit as set forth in claim 1, wherein said damping unit frame is comprised of a plurality of parallel bar-like members and spaced transverse interconnecting members of said bouyant material to which the overlying pad of flexible batting is attached and from which the curtain means of tube form is suspended freely in the form of looped loosely hanging swags of supple sheet material suspended from said parallel members to a substantial depth of the mattress envelope.

18. The combination of a mattress and wave motion damping unit as set forth in claim 1, wherein said damping unit frame is comprised of a plurality of parallel bar-like members and spaced transverse interconnecting members of said bouyant material to which the overlying pad of flexible batting is attached and from which the curtain means of tube form is suspended freely in the form of open ended looped and loosely hanging swags of supple sheet material suspended from said parallel members to a substantial depth of the mattress envelope.

19. The combination of a mattress and wave motion damping unit as set forth in claim 1, wherein said damping unit frame is comprised of a plurality of parallel bar-like members and spaced transverse interconnecting members of said bouyant material to which the overlying pad of flexible batting is attached and from which the curtain means of tube form is suspended freely in the form of looped loosely hanging swags of flexible batting material suspended from said parallel members to a substantial depth of the mattress envelope.

20. The combination of a mattress and wave motion damping unit as set forth in claim 1, wherein said damping unit frame is comprised of a plurality of parallel bar-like members and spaced transverse interconnecting members of said bouyant material to which the overlying pad of flexible batting is attached and from which the curtain means of tube form is suspended freely in the form of open ended looped loosely hanging swags of flexible batting material suspended from said parallel members to a substantial depth of the mattress envelope.

* * * * *